US006380131B2

(12) United States Patent
Griebel et al.

(10) Patent No.: US 6,380,131 B2
(45) **Date of Patent: *Apr. 30, 2002**

(54) COLOR RIBBON FOR THERMO-SUBLIMATION PRINT, METHOD FOR THE MANUFACTURE OF SAME AND ITS APPLICATION

(75) Inventors: Thomas Griebel, Hünenberg; Henrich Krauter, Hombrechtikon, both of (CH)

(73) Assignee: Pelikan Produktions AG, Egg (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/050,929

(22) Filed: Mar. 31, 1998

(30) Foreign Application Priority Data

Apr. 1, 1997 (DE) ..... 197 13 430

(51) Int. Cl.[7] ..... B41M 5/035; B41M 5/38

(52) U.S. Cl. ..... 503/227; 427/152; 428/913; 428/914

(58) Field of Search ..... 8/471; 428/195, 428/447, 913, 914; 503/227; 427/152

(56) References Cited

U.S. PATENT DOCUMENTS 4,664,671 A * 5/1987 Gregory ..... 8/471
5,143,893 A 9/1992 Mochizuki et al. ..... 503/227
5,317,002 A 5/1994 Onishi ..... 503/227
5,334,572 A * 8/1994 Vanier et al. ..... 503/227

FOREIGN PATENT DOCUMENTS

EP 0618081 A1 10/1994 ..... 430/195
GB 2157841 A 10/1998 ..... 503/227
WO WO9634768 A 11/1996 ..... 503/227

OTHER PUBLICATIONS

Patent Abstract of Japan, vol. 016, Nr 370, M–1292, Abstract of JP 04 118290 A (Konica Corp.) Apr. 20, 1992.
WPI/Derwent Database, XP–002071042, JP 5092673, Toppan Printing Co. Ltd., Sep. 30, 1991.

* cited by examiner

*Primary Examiner*—Bruce H. Hess
(74) *Attorney, Agent, or Firm*—Fay, Sharpe, Fagan, Minnich & McKee, LLP

(57) ABSTRACT

Description of a color ribbon for thermo-sublimation print, comprising a carrier and a color layer formed on the carrier, with a sublimeable coloring substance disperse in a polymer binding agent, whereby a top coat is located on the color layer which contains a water-soluble cellulose ether. The cellulose ether preferably contains $C_1$–$C_4$-alkyl- or $C_1$–$C_4$-alkyl-hydroxyalkyl remnants and is specifically. Methyl-hydroxy-ethyl cellulose. The color ribbon has the advantage that the transferred color substance volume is selectively reduced with low print energies, that inside the ribbon spool there is no unwelcome color substance transfer onto the neighboring loops and that during the printing procedure there is no agglutination between the color layer of the color ribbon and the color receiving layer of the receiver foil.

15 Claims, 4 Drawing Sheets

Figure 1A:
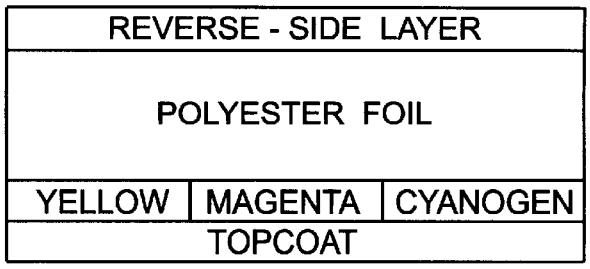
Figure 1B:
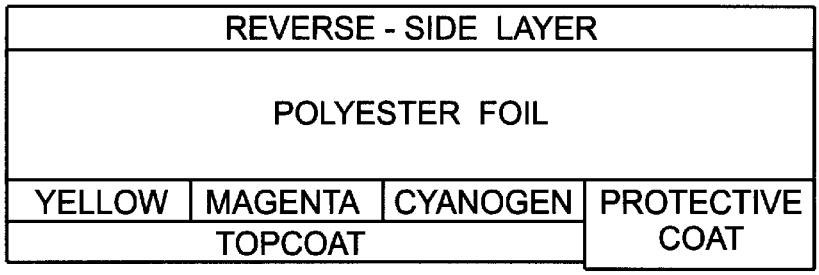
Figure 1C:
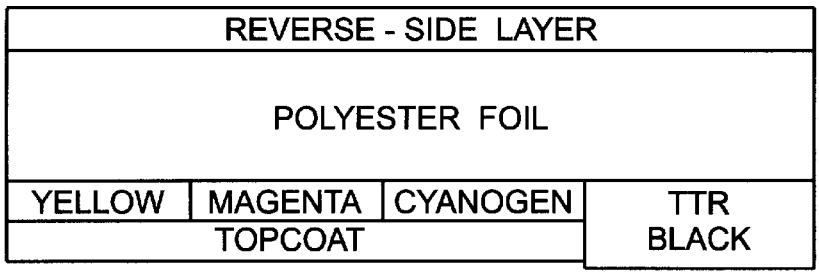
Figure 1D:
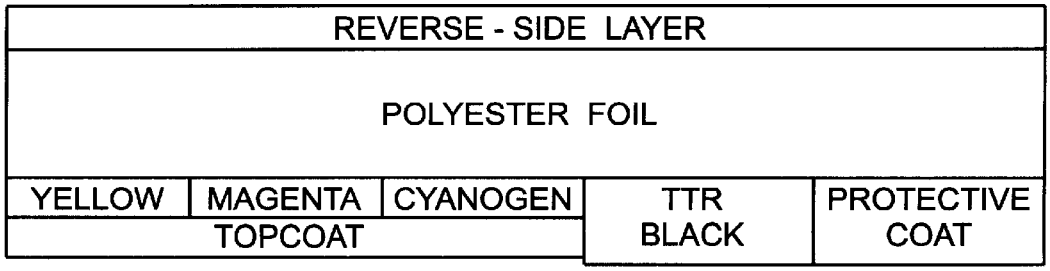

COLOR RIBBON FOR THERMO-SUBLIMATION PRINT, METHOD FOR THE MANUFACTURE OF SAME AND ITS APPLICATION

The present invention concerns a color ribbon for thermo-sublimation print, comprising a carrier, a color layer formed on the carrier, with a sublimable coloring substance dispersed in a polymer binding agent, a method for the manufacture of same and its application.

Print technology based on thermo-sublimation (TDD) has been known for a number of years. It inserts itself, seamlessly, into existing modern picture-taking-, printing- and transmission electronics. At the present time, the quality of the images which is being achieved with these instruments is already close to the quality of normal color photos. For most applications that is adequate. It seems to be only a question of a few years until the resolution of the so called "TDD pictures" will have obtained a top photo quality. Thus it is anticipated that in context with the "still-video camera", traditional photography will be fundamentally revolutionized. The image obtained with a color video camera is first subjected to color separation by means of color filters. The obtained, by color separated, pictures are converted into electrical signals. These signals are further processed, whereby signals are obtained for cyanogen, magenta and yellow and transmitted to a thermo-printer.

The function of the thermo-sublimation print is briefly explained below, whereby this representation will only serve as an example. A special color ribbon with coating in one of the basic colors, cyanogen, magenta or yellow, is arranged on a receptor leaf. This arrangement is brought between a thermal- or print head and a print roller.

Located in the printhead, in single row, are tiny thermal dots, which transmit, with great precision, dot by dot, thermal energy to the reverse side of the color ribbon (100 to 400 thermal dots per inch). The thermal dots are targeted, according to the electronic signals, for either cyanogen, magenta or yellow. Subsequently, the process is repeated for the other two colors. Thus, a color print is obtained which corresponds to the original image seen on a picture screen. The picture is, perhaps, also coated with a very thin film and protected, in this fashion, against outside influences. The printing process is effected by means of a thermal head, which heats up the color ribbon in accordance with the image and transforms the coloring substance at these locations from solid to gaseous state. The coloring substance, in gaseous state, is transferred into the receiving layer of the receptor substrate, also called acceptor- or receiver substrate and is there fixated. Consequently, the entire process constitutes thermal sublimation. However, the coloring substance need not necessarily undergo the gaseous phase in order to dye a foil or plastic layer. Thus, the sublimeable coloring substance can, for example, be applied to the foil by means of thermal transfer print. This is then followed by an after-heating process, in which the coloring substance migrates into the acceptance layer of the receiver leaf. Further details relative to this process and an appropriate device are described in U.S. Pat. No. 4,621,271.

The state of the art already includes a multiplicity of systems of the above described type. Customarily, a TDD ribbon is constructed as follows. The color ribbon consists of at least one carrier and a binder-bonded and the sublimeable coloring substance containing color layer. The receiver leaf has a receiver layer for the coloring substance formed on a carrier. The carrier for the receiver leaf can be a transparent foil, a dual-sided, polyethylene-coated, a barite-coated or a synthetic paper. The carrier may have an inscribable and antistatic reverse side coating. Such system is evident for example from EP-B-O 334-323.

The known ribbons for thermo-sublimation print, however, have several drawbacks. The commercial sublimeable coloring substances frequently possess very low activation energies and are, consequently, transferred out of the color layer at only slightly increased temperature. The result is that already prior to the actual print action, a small amount of sublimeable coloring substance is transferred, within the supply ribbon winder, to the reverse-side coating of the neighboring loop, which in turn, leads to soiling of the print head or the ribbon-guiding components during printing and continued transport of the color ribbon.

In the worst case, the color ribbon may become blocked. The low activation energy of the sublimeable coloring substances leads, moreover, to additional problems. During printing of areas with high optical density, the print head is heated intensively. Since cooling down of the print head requires a certain period of time, it is possible that due to the residual head from the print head there may occur, in the adjacent regions, an unwelcome transfer of coloring substance to the receiver leaf. Said unwelcome transfer of coloring substance expresses itself in form of a color haze over the entire print. Furthermore, the unintentionally transferred color particles penetrate only insufficiently into the surface of the receiver leaf and adhere there superficially, which results in soiling of hands and other articles, which come into contact with the receiver leaf.

The low activation energy of the sublimeable coloring substance leads, in addition, to the transfer of the excessive amounts of coloring material during the printing process. This expresses itself detrimentally in excessive color intensity when printing half tones. The printing of genuine "gray" phases is not possible.

The known systems for thermo-sublimation print are frequently also inadequate in that with good compatibility between the resin systems of the color ribbon or the receiver leaf, there occurs, during printing, some sticking between the color layer of the color ribbon and the receiver layer of the receiver leaf. With finished print, this leads to a roughening of the surface of the receiver leaf or to soiling of the surface of the receiver leaf, due to partial transfer of the entire color layer of the color ribbon to the surface of the receiver leaf. In order to avoid this, it required, until now, excellent fixation of color layer to the color ribbon carrier.

Inasmuch as with thermo-sublimation print the receiver leaf is being printed, successively, with the three basic colors, cyanogen, magenta or yellow, there may be re-transfer of the previously transferred coloring material to or into the color layer of the color ribbon during subsequent printing of a different color. This expresses itself in a reduction of color intensity in regions with multiple print.

In order to solve some of the above described problems, it has already been suggested to chemically interconnect the binder in the color layer of the color ribbon. These methods, however, require complicated and time-consuming production runs, since pot times of coating solution must be accurately observed and thermal "after-curing" is required, frequently taking several hours or days. By chemically interlacing the binder in the color layer, the transferred amount of coloring substances is not only selectively reduced with low print energies, but also, in unwelcome fashion, in those locations where high color intensities are desired. The chemical interlacing of the binder in the color layer provides, furthermore, inadequate reduction of sticking between the color layer of the color ribbon and the receiver layer of the receiver leaf.

Alternatively, it has been suggested to employ in the color layer of the color ribbon, functional additives, for example lubricating or separation agents. These are to prevent any sticking between the color layer of the color ribbon and the color receiving layer of the receiving leaf during the printing process. Use of functional additives however leads to deterioration in the adhesion of the color layer to the carrier foil of the color ribbon and makes no contribution to the prevention or reduction of retransfer of previously transferred coloring substances to or into the color layer of the color ribbon. Functional additives, moreover, have no influence upon the activation energy required for the transfer of the sublimeable coloring substances. Use of functional additives in the color layer of the ribbon thus does not allow reduction of transferred coloring substance volume with low pressure energies.

U.S. Pat. Nos. 5,565,404 and 5,348,931 suggest to develop a cover layer on the color layer of the color ribbon for thermo-sublimation print, which contains the hydrolyzed product of a silane coupling agent. This is to reduce the friction between color ribbon and receiver paper with different transport speeds for color ribbon and receiver paper, specifically with respect to multi-use applications.

The invention is based on the object of making available a color ribbon for thermo-sublimation print which does not have the above described drawbacks and where specifically the transferred amount of coloring substance is selectively reduced with low print energies, where in the ribbon spool there is no unintentional re-transfer to the reverse-side coating of the neighboring turns and where no sticking occurs between the color layer of the color ribbon and the color receiving layer of the receiver leaf.

According to the invention, said object is solved by a color ribbon characterized in that there is on the color layer a cover layer which contains a water-soluble cellulose-ether.

According to the invention, an additional layer is applied onto the color layer of the color ribbon, which contains a water-soluble cellulose-ether. The term "water-soluble" means that the employed cellulose-ether, while being stirred into cold water, will result either in a molecular solution or in a colloidal dispersion. Preferably, the water-soluble cellulose-ether contains $C_1$–$C_4$-Alkyl-and/or $C_1$–$C_4$-hydroxy-alkyl remnants, which are then attached, via ether-compounds, to the cellulose-hydroxyl groups.

The substitution degree DS lies preferably between 1.5 and 3.0, specifically between approximately 1.6 and 2.5. Mixed cellulose ethers with $C_1$–$C_4$-Alkyl remnants and $C_1$–$C_4$-Hydroxy-alkyl remnants are preferred. In this case, the preferred substitution degree for the Alkyl-substitution lies between approximately 1.5 and 2.5 and for the Hydroxy-alkyl -substitution between approximately 0.05 and 0.5. Particularly beneficial results were obtained with a Methyl-hydroxy-ethyl-cellulose, specifically with respect to a cellulose where DS (Methyl)=1.75 and DS (Hydroxy-ethyl)=0.15. Such product is available under the name Tylose MH 50 G4 from Hoechst AG, Germany. The polymerization degree of the employed cellulose-ether lies preferably between approximately 150 to 600, specifically between approximately 200 and 500.

Preferred water-soluble cellulose-ethers distinguish themselves by high foil forming capability, high temperature resistance, i.e. high melting-, softening- and/or decomposition temperature. Its watery solution preferably shows good wetting property and also good adhesion to the color layer of a thermo-sublimation color ribbon without addition of corresponding additives.

In the layer of the water-soluble cellulose-ether, the sublimeable coloring substances are not or only poorly soluble. The cover layer according to the invention does not melt under the attainable print temperatures and is, under the attainable print temperatures also incompatible with the binders in the color layer of the color ribbon and in the color receiving layer of the receiving leaf. These properties of the water-soluble cellulose-ether result in that by means of the cover layer, applied according to the invention, there is produced a barrier for the sublimeable coloring substances, which acts selectively in the range of low print energies. As a result, the activation energies, i.e. the minimum temperatures needed for transfer of sublimeable color substances, are raised and the transferred coloring substance volume reduced with low print energies. Surprisingly, there is no reduction of maximum transferred coloring substance volume in picture areas where high color intensity is desired. In addition, re-transfer of previously transferred coloring material to or into the color layer of the color ribbon is avoided or minimized.

The cover layer applied according to the invention acts, moreover, as separation layer between the color layer of the color ribbon and the color receiving layer of the receiving leaf. The separation effect is based, on the one side, on incompatibility of water-soluble cellulose-ethers with the binders employed in the color receiving layer of the receiving leaf, and also on the sliding effect of the water-soluble cellulose-ethers.

An agglutination of the layers is hereby prevented during the printing procedure. Furthermore, the possibility for variation, which is available to a person skilled in the art, is increased in the selection of resins for the binding agent of the color layer of the color ribbon or the color receiving layer of the receiving leaf.

The cover coating of water soluble cellulose ether, applied according to the invention, is preferably extremely thin, specifically approximately 1 to 50 nm.

The carrier for the color ribbon according to the invention may be any material which is dimensionally stable and resistant to the heat produced in the thermal print head. Materials of this kind are, among others, polyesters, such as polyethylene-terephthalate, polyamide, polycarbonate, fluorized polymers, polyether, polyacetales, polyolefins and polyimides. A particularly preferred color ribbon carrier is a polyester foil available under the name "Diafoil K 203 E" (Diafoil Hoechst Co. Ltd.) which is precoated on one side with an adhesive primer. The border surface tension values of the carrier material are preferably increased by preceding corona treatment. Prior to the corona treatment, the materials typically have border surface tension values of <42 dyn/cm. Via corona treatment the border surface tension values can be raised to a minimum of approximately 50, preferably to a minimum of approximately 56 dyn/cm. The carrier preferably has a thickness of approximately 4–10, specifically approximately 6 to 8 $\mu$m.

The coloring agents in the color ribbon according to the invention are dispersed in a polymer binder. Suitable as binding agents are cellulose derivatives, such as cellulose acetate, cellulose-acetopropionate (obtainable from Eastman under the brand names "CAP-482-05", "CAP-482-20" and "CAP-504-0.2"), cellulose-acetobutryal and/or polyvinyl acetals, such as polyvinyl-butyral (obtainable from Hoechst under the trade name "Mowital") or polyvinyl-alcohol-co-butyral. The polyvinyl-acetals can be beneficially combined with a low-molecular phenol resin (for example "Phenodur PR 263" from Hoechst). Polyvinylbutyral and polyvinyl-alcohol-co-butyral are particularly preferred.

The binding agent for the color layer of the color ribbon according to the invention may be present in interlaced form.

Interlacing can take place, for example, by means of polyfunctional isocyantes, i.e. compounds which contain two or more isocyanate groups in the molecule. Suitable commercial isocyanate interlacers are Desmodur N75, L75 or Vestanat T1890/100. Interlacing leads to improvement in heat resistance and anti-blocking properties of the binding agent systems.

As coloring substances, commercial sublimation or dispersion dyes are suitable for the color ribbon according to the invention. These dyes distinguish themselves in that they do not contain any ionizing groups, are difficult to dissolve in water and are suitable because of colloid-disperse distribution for staining of hydrophobic polyesters. Usage of easily sublimeable dispersion materials, such as the mono- and diazo-colors are particularly advantageous. Suitable sublimation coloring substances are disclosed in U.S. Pat. Nos. 4,541,830, 4,698,651, 4,695,287, 4,701,439, 4,757,046, 4,743,582, 4,769,360 and 4,753,922. Suitable coloring substances are obtainable under the following brand names: Ceres (Bayer), Samaron (Hoechst), Macrolex (Bayer), MS (Mitsui Toatsu), Kayaset (Nippon Kayaku), Teraprint (Ciba Geigy), Dispersol (ICI), Waxiline (Zeneca) and SE (BASF).

The color coating of the color ribbon according to the invention has preferably a thickness of approximately 0.3 to 0.5 $\mu$m, specifically approximately 0.8 to 1.5 $\mu$m. The colored ribbon, according to the invention, can be used as continuous ribbon or in leaf form. If employed as continuous ribbon, it may also contain only one coloring substance or it may contain alternating regions of different coloring substance types, such as sublimeable cyanogen- and/or magenta- and/or yellow- and/or black or other colors. In a preferred specific embodiment of the invention, the color layer has sequentially repetitive or parallel extending regions (color fields) of yellow-, cyanogen- and magenta color. Above the color fields of thermo-sublimeable dye, there is respectively arranged the cover coating containing the water-soluble cellulose ether.

In a preferred specific embodiment, the color ribbon according to the invention contains in repetitive sequence, one of several color fields with sublimeable coloring material and areas containing no color layer, which preferably consist of a transparent protective coating field.

In another preferred specific embodiment, the color ribbon according to the invention contains in repetitive sequence, one or several color fields with sublimeable color substance and one or several thermo-transfer color layer fields. The thermo-transfer color layer may be pictorially detached, by reverse-side warming of the color ribbon carrier, and transferred to the accepting substrate. Preferably, the sequence of color fields with sublimeable yellow-, cyanogen and magenta color alternates with a black thermo-transfer color coating field. The black thermo-transfer color layer permits, for example, production of print-outs showing greater contrast, in that in one pass-through by itself, the black thermo-transfer color layer is transferred in black picture areas. The disadvantage is hereby avoided, of being unable to obtain genuine "deep black" by means of subtractive color mixing of the three basic colors, yellow, cyanogen and magenta.

The color ribbon according to the invention may naturally also contain in repetitive sequence, one or several color fields with sublimeable coloring substance, one or several fields of one thermo-transfer color layer and fields without any color layer.

The invention additionally concerns a method for the manufacture of a color ribbon for thermo-sublimation print, specifically a color ribbon described in the foregoing. The process consists of the following steps:

a) a color ribbon carrier is coated with a first coating solution while forming a color layer, with said first coating solution containing a binding agent, at least one sublimeable color substance and an organic solvent, b) the organic solvent is evaporated, and c) the color layer is coated with a second coating solution, which said second coating solution contains a watery solution of a water-soluble cellulose-ether.

The application of the first coating solution is preferably done with screen rollers, via gravure printing or micro-gravure printing process. Suitable as organic solvents are for example, toluol, xylol, cyclohexanon, butanon, isopropanol and mixtures thereof. Following evaporation of the organic solvent, a second coating solution is applied onto the color layer, which contains a watery solution of a water-soluble cellulose ether. The second coating solution may, in addition, contain up to 25% by weight of organic water-miscible solvents, such as lower alcohols, for example methanol, ethanol, propanol, isopropanol, butanol, glycols, such as ethyleneglycol, glycerine and acetone and/or surface-active agents. The second coating solution contains preferably 0.01 to 2.5 percent by weight, specifically approximately 0.1 to 0.6 percent by weight of water-soluble cellulose ether.

Application of the second coating solution is likewise preferably done with screen rollers, in the engraving or micro-engraving print method. Application of the cover layer from watery phase has the advantage that incipient detachment of the previously applied color layer is impossible. Incipient detachment of the color layer during later coating action would be detrimental to the extent in that the color layer contains the three basic colors in mostly parallel or block-shaped arrangement and would result in "smearing" during incipient detachment. Furthermore, the application of cover layer from watery phase permits accurate control of the to be observed thin layer thickness. On the reverse side of the color ribbon carrier may be beneficially be formed a reverse side coating. The reverse side coating usually consists of wax, polyurethane and/or silicone as well as anti-statica. It is preferably about 0.01 to 0.02 thick, specifically approximately 0.05 to 0.1 $\mu$m. Its purpose is to prevent agglutination of foil and thermal head. It furthermore prevents agglutination of the color ribbon in rolled-up state.

The invention concerns, furthermore, employment of the above described color ribbon for imprinting a receiver leaf, which has a color receiver layer of a resin with high color acceptance capability. The resin of the color receiving layer is preferably selected from among polycarbonate, polyurethane, polyester, polyvinyl-chloride, polyvinyl-acetate, Poly (vinylchloride-co-vinylacetate), styrol-acryl-copolymer, polycaprolacton or mixtures of these.

In one specific embodiment, the color ribbon according to the invention may be used for imprinting an unsupported PVC layer, specifically a PVC card. The unsupported PVC layers are approximately 500 to 1,500 $\mu$m thick.

In another specific embodiment, the color ribbon is used for imprinting a receiver leaf, which has a color receiving layer formed on a support. Suitable carrier materials are polyester, specifically polyethylene -terephthalate, and also paper-polypropylene laminate. The carrier of the acceptance page preferably has a thickness of approximately 100 to 180 $\mu$m, specifically approximately 120 to 160 $\mu$m. The receiver page has preferably a thermal conductivity in the direction of the surface normal of less than approximately 0.40 W/mk, preferably of less than 0.25 and specifically of less than approximately 0.18 W/mK The color receiver layer is preferably approximately 1.5 to 15 μm thick, specifically approximately 2 to 12 μm thick.

The following method may be used for determination of thermal conductivity: specific heat, temperature conductivity and density of receiver leaf are determined at room temperature. From the obtained values, the thermal conductivity is calculated according to the following formula:

$$K=\alpha\rho c_p$$

with k=thermal conductivity

α=temperature conductivity

ρ=density, and $c_p$=specific heat capacity at constant pressure.

For determination of temperature conductivity a photo-acoustical method was employed. In this method, the front side of the probe is radiated with sinusoidally modulated laser light, whereby the modulation frequency is varied over a given range. The temperature increase on the surface of the probe lies in the range from 1 to 2° C. The temperature conductivity is determined as a function of the modulation frequency from the amplitude and phase displacement of the resulting temperature oscillations on the reverse side. The specific thermal capacity of the probes was ascertained with a Perkins-Elmer differential scanning calorimeter, the density with the buoyancy method.

Low thermal conductivity can be achieved, on the one side, by using a carrier material having high thermal resistance or a carrier material which has air-filled hollow spaces. In this specific embodiment, the carrier material preferably contains 15 to 25% of occluded air. Suitable materials are: micro-porous polyester or polypropylene foils. For production of these, several layers are extruded, joined into a laminate and stretched biaxially. During the manufacturing process, tiny hollow spaces are created. Such materials preferably have micro-pores on the surface which contribute toward further anchoring of color receiver layer. On the other side, or additionally, there exists the possibility of lowering the thermal conductivity of the receiver leaf in that the receiver leaf is supplied with layers on the front- and/or reverse side, into which are incorporated thermo-isolating particles, specifically micro-hollow spheres. The low thermal conductivity of the receiver leaf effects that the heat generated by the print head is mostly available for the color transfer reaction. As a result, high optical density and high color saturation is obtained.

Preferably, a reverse side layer or compensation layer is applied to the reverse side of the receiver leaf, which is preferably imprintable and has antistatic properties. It prevents any curling or undulation of the receiver leaf. The compensation layer consists preferably of acrylate resins, silicic acid and antistatica (for example SR-700 by Krahn Chemie GmbH). It is preferably approximately 1 to 5 μm thick. It may, as stated above, contain thermo-isolating micro-particles.

The printing procedure executed with the color ribbon according to the invention includes the pictorial heating and transfer onto the accepting substrate of a colored image. The system consisting of color ribbon and receiver leaf can, if merely a monochromatic image is wanted, be joined into a pre-assembled unit. This may be done by means of provisional glueing of components at their edges. After transfer of the coloring substance, the receiver leaf is merely pulled off.

If a multi-colored is wanted, the color ribbon (or an area of the color ribbon) is brought in sequential order into contact with the receiver foil during the printing procedure. After the first coloring material has been transferred, the elements are separated and a second color ribbon (or another area of the color ribbon) are brought into contact with the receiver leaf and the procedure is then repeated. A third (and each additional) color is obtained in like manner.

Figure 2:
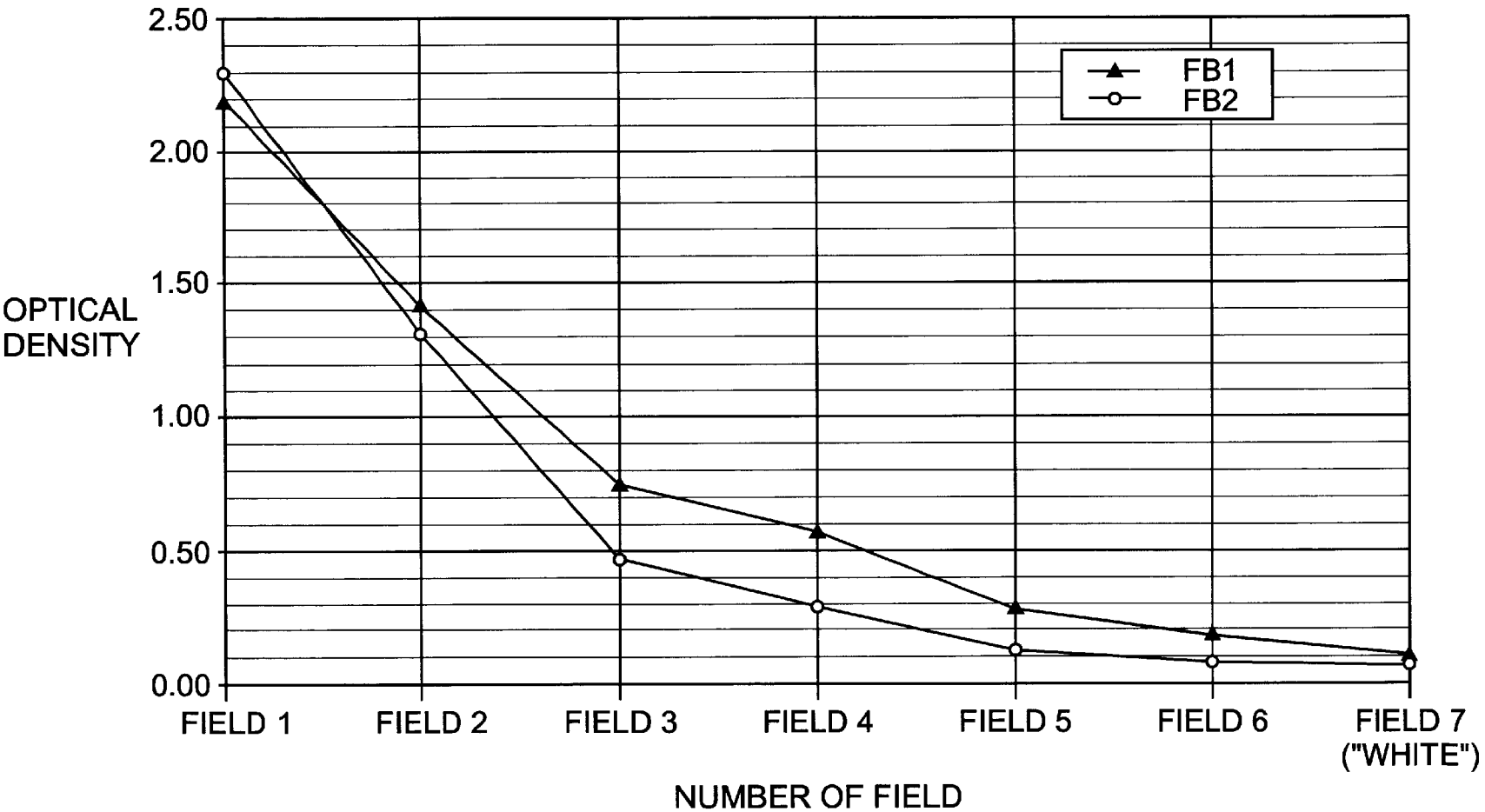
Figure 3:
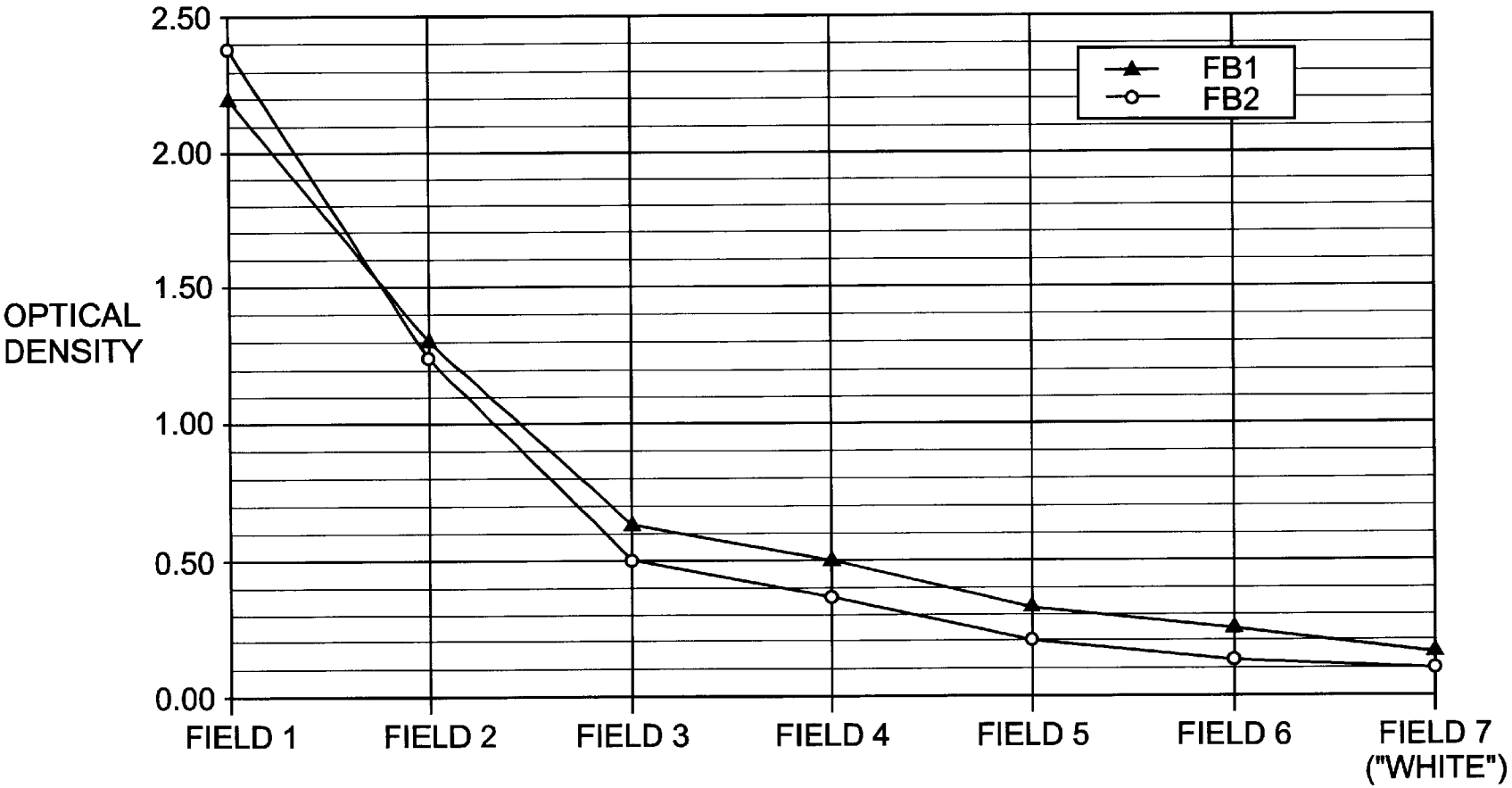
Figure 4:
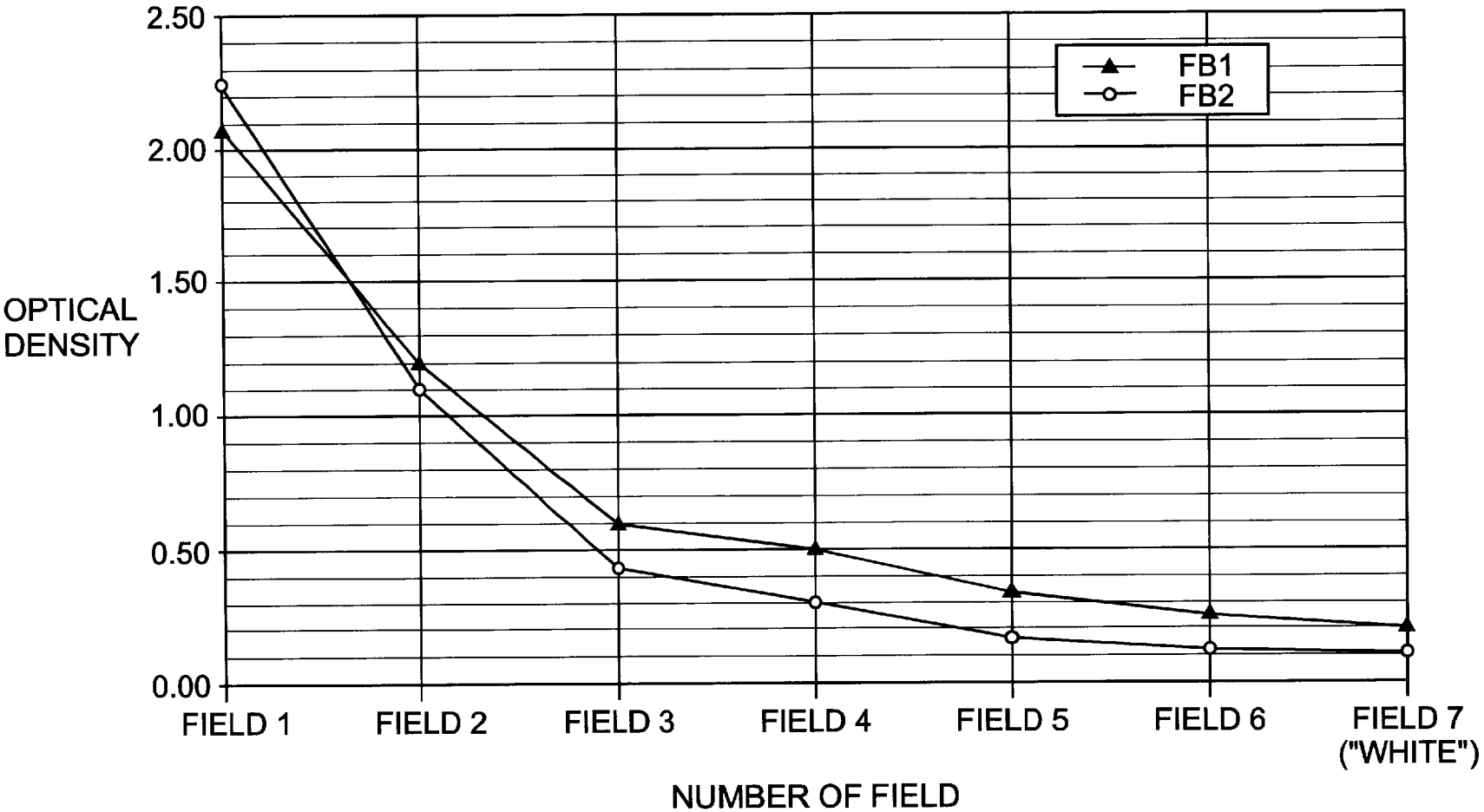

The invention is now explained in more detail, based on the examples which follow and on the appended drawings. In the drawings, FIG. 1 represents preferred types of construction of a color ribbon according to the invention. FIG. 2 represents the optical densities ascertained in the seven fields of a yellow color cone, which was printed out with a thermo-sublimation color ribbon without top layer or with a thermo-sublimation color ribbon with top layer according to the invention. FIG. 3 represents the optical densities of a thermal-sublimation color ribbon ascertained in the seven fields of a magenta color cone, which was printed out with a thermo-sublimation ribbon without top layer or with a thermo-sublimation color ribbon with top layer according to the invention. FIG. 4 represents the optical densities ascertained in the seven fields of a cyanogen color cone, which was printed out with thermo-sublimation ribbon without top layer or with a thermo-sublimation color ribbon with top layer according to the invention.

With reference to FIG. 1, a color ribbon according to the invention contains in a preferred specific embodiment a color ribbon carrier with a reverse side layer and a color layer. The color layer consists of a repetitive sequence of the color fields, with thermo-sublimeable coloring material (TDD color fields; yellow, magenta, cyanogen). Above the TDD color fields there is applied the top layer (top coat) containing water-soluble cellulose ether (FIG. 1*a*). In FIG. 1*b*, a color ribbon according to the invention is depicted, with a color ribbon carrier having on its reverse-side layer three TDD color fields (yellow, magenta, cyanogen) which alternate with a field without any color. In the field without color, the gap between the TDD color field is filled with a protective coating. In FIG. 1*c*, a color ribbon according to the invention is shown where three TDD color fields (yellow, magenta, and cyanogen) alternate with a field of a thermo-transferable color layer (TTR field) (black) on the reverse-side layer of a color ribbon carrier. FIG. 1*d* shows a color ribbon according to the invention where on a color ribbon carrier with reverse-side layer, three TDD color fields (yellow, magenta, cyanogen) alternate with a TTR field (black) and a protective coating field. In the color ribbons represented in FIGS. 1*b* to 1*d*, the top coat layer is applied only over the TDD color fields.

COMPARISON EXAMPLE 1

This example explains the manufacture of a thermo-sublimation color ribbon without top coat.

A polyester foil, available under the trade name "Diafoil D 203 E" (Diafoil Hoechst Co. Ltd) having been predated on one side with an adhesive primer, and with a thickness of 5.5 μm, was subjected to Corona treatment on both sides. After the treatment, the foil showed a surface tension value of 56 dyn/cm. A coating solution for the layer on the reverse side was prepared according to the following recipe:

| | |
|---|---|
| Polyurethane "Permuthan SU-5001" (Stahl Holland bv): | 2.50% by weight |
| Ester wax "Hoechst Wax OP" (Hoechst AG) | .75% by weight |
| Antistaticum "Lanco-Stat K 100" (Lanco Langer & Co.) | 0.03% by weight |

-continued

| | |
|---|---|
| coloring mtl. "Spezialrot 3R" (Bayer AG): | 0.02% by weight |
| Toluol | 63.00% by weight |
| 2-Propanol | 37.70% by weight |

The coating solution was applied via micro -gravure print, in an application volume of 0.10 g/cm$^2$ (dry weight) onto the side of the polyester foil opposite the adhesive primer layer.

Coating solutions for the individual color layers were prepared according to the following recipes:

| Yellow Color Layer | |
|---|---|
| Color "MS Yellow VP" (Mitsui Toatsu Chemicals Inc.) | 6.0% by weight |
| Polyvinyl-butyral resin "Mowital B 60 H" (Hoechst AG): | 6.0% by weight |
| Butanon: | 25.1% by weight |
| Cyclohexanon: | 62.9% by weight |

| Color Layer Magenta | |
|---|---|
| Color "MS Magenta VP" (Mitsui Toatsu Chemicals, Inc.): | 3.6% by weight |
| Color "Kayaset Red B" (Nippon Kayaku Co., Ltd): | 1.2% by weight |
| Color "Bayscript Spezialrot T" (Bayer AG): | 1.2% by weight |
| Polyvinyl-butyl resin "Mowital B 60 H" (Hoechst AG.) | 6.0% by weight |
| Butanon | 25.1% by weight |
| Cyclohexanon | 62.9% by weight |

| Color Layer Cyanogen | |
|---|---|
| Color "Kayaset Blue 714" (Nippon Kayaku Co., Ltd.): | 6.6% by weight |
| Polyvinyl-butyral resin "Mowital B 60 H" (Hoechst AG): | 5.4% by weight |
| Butanon | 25.1% by weight |
| Cyclohexanon: | 62.0% by weight |

The coating solutions for the individual color layers, yellow, magenta and cyanogen are applied by micro-gravure print, with coating thickness of 1.0 g /m$^2$ (dry weight) over the adhesive primer coating of the polyester foil. The thusly produced color ribbon was identified with FB1.

EXAMPLE 2

This example explains the manufacture according to the invention of a thermo-sublimation color ribbon.

A color ribbon was prepared according to description in Example 1. Above the color layers, however, a coating solution was applied by micro-gravure print in a thickness of 0.01 g/m$^2$ according to the following recipe:

| | |
|---|---|
| Methylhydroxy-ethylcellulose "Tylose MH 50 G4" (Hoechst AG) | 0.3% by weight |
| Water | 99.7% by weight |

The thusly prepared color ribbon was identified with FB2.

COMPARATIVE EXAMPLE 3

This example explains the manufacture of a thermo-sublimation color ribbon, which has, in repetitive sequence, aside from the three TDD color layers of yellow, magenta and cyanogen, a thermo-transferable black color layer (TTR).

A color ribbon was produced according to the description in Example 1, whereby, however, after each three TDD color fields, a TTR black layer was formed. The coating mass for the TTR black layer was prepared according to the following recipe:

| | |
|---|---|
| Polyester resin "Dynapol L 952" (Huels AG): | 8.0% by weight |
| Hydrocarbon resin "Novares TS 120" (Ruetgers-Vft AG) | 4.0% by weight |
| "Carnauba wax" (Pierre Lira) | 1.6% by weight |
| Silicic acid "HDK N 20" (Wacker AG): | 1.4% by weight |
| Russ "Printex 150 T" (Degussa): | 6.0% by weight |
| Toluol: | 80.0% by weight |

The coating was applied by micro-gravure print with a coating thickness of 2.0 g/m$^2$ (dry weight). The thusly prepared color ribbon was identified with FB3.

EXAMPLE 4

This example explains the manufacture of a thermo-sublimation color ribbon according to the invention with additional TTR black color fields.

The same procedure was followed as described in Comparative Example 3, however, in accordance with the description in Example 2, a top coat was developed over the TDD color layers. The thusly manufactured color ribbon was identified with FB4.

EXAMPLE 5

This example explains the manufacture of various color receiving leafs which may be used in conjunction with the thermo-sublimation color ribbons according to the invention.

Color Receiving Leaf for Photo Print on Polyester Basis

A coating solution for the reverse side coating was prepared according to the following recipe:

| | |
|---|---|
| Polymethylmethacrylate "Plexigum M 527" (Roehm GmbH): | 10.0 by weight |
| Silicium-dioxide "Gasil 200 DF" (Crossfield Group) | 0.4% by weight |
| Antistaticum "SR 700" (Krahn Chemie) | 0.3% by weight |
| Toluol | 80.0% by weight |
| 2-Propanol | 9.3% by weight |

The coating solution was applied by micro-gravure print in a coating thickness of 1.5 g/m$^2$ (dry weight) onto a polyester foil "Melinex 347" (ICI Films), having a thickness of 125 $\mu$m, which had been precoated, on both sides, with an adhesive primer. After that a coating solution for the color receiving layer was prepared according to the following recipe:

| | |
|---|---|
| Poly(vinylchloride-co-vinylacetate) "Vinylite VYHH" (Union Carbide) | 15.1% by weight |
| Aliphatic Polyisocyanate "Desmodur N 75" (Bayer AG): | 0.8% by weight |

-continued

| | |
|---|---|
| Antistaticum "Tebestat BK" (Dr. Th. Boehme KG Chemische Fabrik) | 0.8% by weight |
| Flow-aid agent "FC 431" (3M) | 0.8% by weight |
| Toluol | 52.0% by weight |
| 2-Propanol | 4.5% by weight |
| Butanon | 26.0% by weight |

The coating solution for the color receiver layer was applied by micro-gravure print in a coating thickness of 3.0 g/m$^2$ (dry weight) onto the side of the polyester foil facing the reverse-side layer. The thusly prepared color receiver leaf was identified with FEB1.

Color Receiver Page for Photo Print on Paper Base

Manufacture was done in accordance with preceding description, except that a carrier material, a paper substrate (total thickness 165 $\mu$m Felix Schoeller Digital Imagin) was used that had been laminated on both sides and which was subjected, prior to coating, to Corona treatment on both sides, whereby a surface tension value of 56 dyn/cm was obtained. The thusly prepared color receiving leaf was identified with FEB2.

Color Receiver Leaf for Photo Print on Polyester Basis

The manufacture of the color receiver leaf corresponds to the manufacture described for FEB1, except that the following recipe was used as coating solution for the color receiver leaf:

| | |
|---|---|
| Linear Co-Polyester "Dynapol L-206" (Huels AG): | 7.5% by weight |
| Cycloaliphatic Polyisocyanate "Vestanat T 1890/100" (Huels AG) | 2.3% by weight |
| Flow-Aid Agent "FC 431" (3M) | 0.4% by weight |
| Toluol | 34.9% by weight |
| Butanon | 44.9% by weight |
| Cyclohexanon | 10.0% by weight |

The thus manufactured color receiver page was identified with FEB3.

Color Receiver Page for Photo Print on Polyester Basis

Manufacture corresponds to the description given for FEB1, with the exception that the following recipe was employed for the coating solution for the color receiver leaf:

| | |
|---|---|
| Linear Co-Polyester "Dynapol L-850 (Huels AG): | 7.5% by weight |
| Cycloaliphatic Polyisocyanate "Vestanat T 1890/100" (Huels AG) | 2.3% by weight |
| Flow-Aid Agent "FC 431" (3M) | 0.4% by weight |
| Toluol | 34.9% by weight |
| Butanon | 44.9% by weight |
| Cyclohexanon | 10.0% by weight |

The thusly prepared color receiver leaf was identified with FEB4.

Color Receiver Page for Photo Print on Polyester Basis

Manufacture of the color receiver leaf corresponds to description given for FEB1, with the exception that the following recipe was used for the color receiver leaf.

| | |
|---|---|
| Linear Co-Polyester "Dynapol L-206 (Huels AG): | 3.8% by weight |
| Linear Co-Polyester "Dynapol L-850" (Huels AG) | 3.8% by weight |

-continued

| | |
|---|---|
| Cyclo-aliphatic Polyisocyanate "Vestanat T 1890/100" (Huels AG) | 2.3% by weight |
| Flow-Aid Agent "FC 431" (3M) | 0.4% by weight |
| Toluol | 34.9% by weight |
| Butanon | 44.9% by weight |
| Cyclohexanon | 10.0% by weight |

The thusly manufactured color receiver leaf was identified with FEB5.

Pigmented Color Receiver Leaf for Photo Print on Polyester Basis

Manufacture of the color receiver leaf corresponds to the description given for FEB1, except that the following recipe was used to form the coating mass of the color receiver layer, which was applied by micro-gravure print in a thickness of 7.5 g/m$^2$ (dry weight).

| | |
|---|---|
| Poly(vinylchloride-co-vinylacetate) "Vinyl VYHH" (Union Carbide) | 14.5% by weight |
| Aliphatic Polyisocyanate "Desmodur N 75" (Bayer AG) | 0.8% by weight |
| Titanium-dioxide "Bayer R-FD-I" (Bayer AG) | 3.5% by weight |
| Optical Lightener "Blankophor MAN" (Bayer AG) | 0.2% by weight |
| Antistaticum "Tebestat BK" (Dr. Th. Boehme KG Chemische Fabrik) | 0.8% by weight |
| Flow-Aid "FC-431" (3M): | 0.8% by weight |
| Toluol | 50.0% by weight |
| 2-Propanol | 4.4% by weight |
| Butanon | 25.0% by weight |

The thusly manufactured color receiver leaf was identified with FEB6.

Pigmented Color Receiver Leaf for Photo Print on Paper Basis

The same description was followed as for FEB6, except that the carrier material was used which was employed in the description for the manufacture of FEB2.

The thusly manufactured color receiver leaf was identified with FEB7. PVC Card for ID Card Print:

Polyvinyl-chloride cards were used, called "PVC Blank 076" (F+O Electronic Systems GmbH) having a thickness of 750 $\mu$m. These were identified with FEB8.

EXAMPLE 6

The previously described color ribbons were used in printers listed in Table 1, for imprinting of above described color receiving foils. An evaluation of the printing behavior and the printing results are listed in Table 1.

When using the color ribbons with top coat according to the invention, one does not note, during the printing procedure, any agglutination of the color ribbon with the different color receiver foils. The color ribbons according to the invention may be combined, based on the applied top coat and its function as separation layer, with a great number of different color receiver foils. With usage of color ribbons with top coat according to the invention, there is no soiling of the color receiver leaf surface by re-sublimated color particles. With comparative color ribbons without top coat there is color transfer by residual heat from the print head, whereby such residual heat from print head is not enough to facilitate diffusion of the color substances into the color receiver layer of the color receiver leaf.

When employing the color ribbons according to the invention, one generally notes, following printing, a shining, clean color receiver leaf surface. When employing color ribbons with top coat according to the invention, color intensity is reduced, specifically with respect to the printing of half-tones, i.e. printing of correct color cones is made possible. Nor does one note any color haze in the light print areas.

EXAMPLE 7

The color ribbon, according to the invention and the comparison color ribbons were stored for 3 months at room temperature or at 50° C. Subsequently they were given a visual inspection. The Results are summarized in Table 2.

With respect to the color ribbons with top coat according to the invention, one does not note, during storage, any unwelcome color transfer inside the ribbon spool to the reverse side of a neighboring loop. This either minimizes of excludes any possibility of soiling and subsequent damage to the print head because of color substance deposits. Even at higher temperatures, the color ribbons according to the invention show no inclination toward agglutination, as may be the case with color ribbons without top coat.

ribbons with top coat according to the invention, slightly higher optical densities are obtained than with usage of the comparative color ribbon without top coat. It is assumed that this is based on the lower loss of color substance during storage due to smaller color substance transfer onto the reverse side layer and reduction in color material re-transfer during printing, as well as higher color brilliancy because of elimination of troublesome color haze.

In the range of low print energies, the optical densities are reduced with respect to the color ribbon according to the invention. The top coat, applied according to the invention, functions as a barrier for the color material, making possible printing of correct color cones. During printing with color ribbons with top coat according to the invention, "white" printing areas (Field 7) merely show the inherent color of the accepting substrate.

TABLE 1

| | | | Evaluation of Printing Behavior and Printing Results | | | | |
|---|---|---|---|---|---|---|---|
| Color Ribbon (FB) | Color Receiver Page (FEB) | Printer | Agglutination of Color Ribbon and Color Receiver Page During Printing Action (Printer Noise) | Soiling of Color Receiver Page Surface by Re-Sublimated Color Substance | Shining, Clean Color Receiver Page Surface After Printing | Excessive Color Intensity (Optical Density) in Half-Tone Pringing | Color Haze - Particularly Visible on Light Print Regions |
| Example FB 1 | Example FEB 1 | Hitachi VY-200A | little (o) | yes (−) | no (−) | yes (−) | yes (−) |
| Example FB 2 | Example FEB 1 | Hitachi VY-200A | no (+) | no (+) | yes (+) | no (+) | no (+) |
| Example FB 1 | Example FEB 2 | Hitachi VY-200A | no (+) | yes (−) | no (−) | yes (−) | yes (−) |
| Example FB 2 | Example FEB 2 | Hitachi VY-200A | no (+) | no (+) | yes (+) | no (+) | no (+) |
| Example FB 1 | Example FEB 3 | Hitachi VY-200A | little (o) | yes (−) | no (−) | yes (−) | yes (−) |
| Example FB 2 | Example FEB 3 | Hitachi VY-200A | no (+) | no (+) | yes (+) | no (+) | no (+) |
| Example FB 1 | Example FEB 4 | Hitachi VY-200A | little (o) | yes (−) | no (−) | yes (−) | yes (−) |
| Example FB 2 | Example FEB 4 | Hitachi VY-200A | no (+) | no (+) | yes (+) | no (+) | no (+) |
| Example FB 1 | Example FEB 5 | Hitachi VY-200A | little (o) | yes (−) | no (−) | yes (−) | yes (−) |
| Example FB 2 | Example FEB 5 | Hitachi VY-200A | no (+) | no (+) | yes (+) | no (+) | no (+) |
| Example FB 1 | Example FEB 6 | Hitachi VY-200A | no (+) | yes (−) | no (−) | yes (−) | yes (−) |
| Example FB 2 | Example FEB 6 | Hitachi VY-200A | no (+) | no (+) | yes (+) | no (+) | no (+) |
| Example FB 1 | Example FEB 7 | Hitachi VY-200A | no (+) | yes (−) | no (−) | yes (−) | yes (−) |
| Example FB 2 | Example FEB 7 | Hitachi VY-200A | no (+) | no (+) | yes (+) | no (+) | no (+) |
| Example FB 3 | Example FEB 8 | Atlantek 85 RS | little (o) | yes (−) | no (−) | yes (−) | yes (−) |
| Example FB 4 | Example FEB 8 | Atlantek 85 RS | no (+) | no (+) | yes (+) | no (+) | no (+) |

EXAMPLE 8

The color ribbon according to Comparison Example 1 (FB1) and the color ribbon according to the invention as per Example (FB2) were used in a Hitachi VY-200A for printing of color receiver leaf FEB2. Yellow-, magenta-, and cyanogen colored cones with seven fields were printed. Subsequently, an appropriate instrument was employed in order to determine the optical density within the individual fields (arbitrary units). The results are represented in FIGS. 2 to 4. With high print energies (Field 1) while using color

TABLE 2

| Color Ribbon (FB) Evaluation of Storage Behavior Inside Ribbon Spool | | | |
|---|---|---|---|
| | Transfer of color to reverse-side layer | Agglutination of Color Ribbon at Room Temperature | Agglutination of Color Ribbon at higher Temperatures (50° C.) |
| Example FB 1 | yes (−) | no (+) | yes (−) |
| Example FB 2 | no (+) | no (+) | little (o) |

TABLE 2-continued

| Color Ribbon (FB) Evaluation of Storage Behavior Inside Ribbon Spool | | | |
|---|---|---|---|
| | Transfer of color to reverse-side layer | Aggulatination of Color Ribbon at Room Temperature | Agglutination of Color Ribbon at higher Temperatures (50° C.) |
| Example FB 3 | yes (–) | no (+) | yes (–) |
| Example FB 4 | no (+) | no (+) | little (o) |

What is claimed is:

1. Color ribbon for thermo-sublimation print, comprising a carrier and a color layer formed on the carrier, with a sublimeable coloring agent dispersed in a polymer binder selected from the group consisting of cellulose derivatives, polyvinyl acetals and mixtures thereof, wherein on the color layer is located a top coat which contains water-soluble methyl-hydroxyethyl-cellulose and the top coat is approximately 1–50 nm thick and wherein the substitution degree for the alkyl-substitution lies between approximately 1.5 and 2.5 and for the hydroxyalkyl-substitution between 0.05 and 0.5.

2. Color Ribbon according to claim 1, characterized in that the binder for the color layer is chosen from polyvinyl-butyral and/or polyvinyl-alcohol-co-butyral.

3. Color Ribbon according to claim 1, characterized in that a coating of wax, polyurethane and/or silicone is arranged on the reverse-side of the color ribbon.

4. Color Ribbon according to claim 1, characterized in that the carrier of the color ribbon has a thickness of approximately 4 to 10 $\mu$m, specifically approximately 6 to 8 $\mu$m.

5. Color Ribbon according to claim 1, characterized in that the color layer has a thickness of approximately 0.5 to 3 $\mu$m, specifically approximately 0.8 to 1.5 $\mu$m.

6. Method for the manufacture of a Color Ribbon for thermo-sublimation, whereby a) a color ribbon carrier is coated with a first coating solution, forming a color layer, which first coating solution contains a polymer binder, at least one sublimeable coloring substance and an organic solvent, b) the organic solvent is evaporated and c) the color layer is coated with a second coating solution, which second coating solution contains a watery solution of a water-soluble methyl-hydroxyethyl-cellulose.

7. Method according to claim 1, characterized in that the top coat is applied in a thickness of from 1–50 nm.

8. A method of imprinting a receiver foil including a color receiver layer of a resin with high resin with high color absorption capability comprising the heating of the ribbon of claim 1 to transfer an image onto the receiver foil.

9. The method of claim 8, wherein the resin of the color receiver layer is selected from among polycarbonate, polyurethane, polyester, polyvinylchloride, polyvinylacetate, poly(vinylchloride-co-acetate), styrol-acrylnitirl-copolymer, polycaprolacton or mixtures thereof.

10. The method of claim 8, wherein receiver foil further comprises an unsupported PVC layer.

11. The method of claim 8, wherein the receiver foil has a color receiving layer formed on a carrier.

12. The method of claim 11, wherein the carrier of the receiver foil has air-filled hollow spaces.

13. The color ribbon of claim 1 wherein said polymer binder is selected from cellulose acetate, cellulose-acetopropioniate, cellulose-acetobutryal and mixtures thereof.

14. The color ribbon of claim 1 wherein said polymer binder is selected from polyvinyl-butyral, polyvinyl-alcohol-co-butyral and mixtures thereof.

15. The color ribbon of claim 1 wherein said cellulose ether comprises between 0.01 to 2.5% by weight of said top coat.

* * * * *